US009852844B2

(12) United States Patent
Golko et al.

(10) Patent No.: US 9,852,844 B2
(45) Date of Patent: Dec. 26, 2017

(54) MAGNETIC SHIELDING IN INDUCTIVE POWER TRANSFER

(71) Applicant: Apple Inc., Cupertino, CA (US)

(72) Inventors: Albert J. Golko, Saratoga, CA (US); Eric S. Jol, San Jose, CA (US); Christopher S. Graham, San Francisco, CA (US); Stephen E. Yao, Santa Cruz, CA (US); Makiko K. Brzezinski, Cupertino, CA (US); Daniel C. Wagman, Scotts Valley, CA (US); Paul J. Thompson, Mountain View, CA (US); Nagarajan Kalyanasundaram, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 351 days.

(21) Appl. No.: 14/666,793

(22) Filed: Mar. 24, 2015

(65) Prior Publication Data

US 2015/0270058 A1 Sep. 24, 2015

Related U.S. Application Data

(60) Provisional application No. 61/969,337, filed on Mar. 24, 2014, provisional application No. 62/036,685, filed on Aug. 13, 2014.

(51) Int. Cl.

| | |
|---|---|
| ***H01F 38/14*** | (2006.01) |
| ***H01F 27/36*** | (2006.01) |
| *H01F 27/34* | (2006.01) |

(52) U.S. Cl.

CPC ..... *H01F 38/14* (2013.01); *H01F 27/365* (2013.01); *H01F 2027/348* (2013.01)

(58) Field of Classification Search

CPC .. H02J 50/05; H02J 50/10; H02J 50/12; H02J 50/15; H02J 50/20; H02J 50/23; H02J 50/27; H02J 50/30; H02J 50/40

(Continued)

(56) References Cited

U.S. PATENT DOCUMENTS

| | | | |
|---|---|---|---|
| 2,471,869 | A | 5/1949 | Gebel |
| 3,676,814 | A | 7/1972 | Trunzo et al. |

(Continued)

FOREIGN PATENT DOCUMENTS

| | | |
|---|---|---|
| CN | 201584257 U | 9/2010 |
| CN | 102611215 | 7/2012 |

(Continued)

OTHER PUBLICATIONS

Invitation to Pay Additional Fees, PCT/US2015/022222, 7 pages, Aug. 3, 2015.

(Continued)

*Primary Examiner* — John Poos

(74) *Attorney, Agent, or Firm* — Kilpatrick Townsend & Stockton LLP

(57) ABSTRACT

A first electronic device connects with an second electronic device. The first electronic device may include a first connection surface and an inductive power transfer receiving coil and a first magnetic element positioned adjacent to the first connection surface. The second electronic device may similarly include a second connection surface and an inductive power transfer transmitting coil and second magnetic element positioned adjacent to the second connection surface. In the aligned position, alignment between the electronic devices may be maintained by magnetic elements and the inductive power coils may be configured to exchange power. The magnetic elements and/or the inductive power coils may include a shield that is configured to minimize or (Continued)

reduce eddy currents caused in the magnetic elements by the inductive power coils.

29 Claims, 15 Drawing Sheets

(58) Field of Classification Search
USPC ..... 307/104
See application file for complete search history.

(56) References Cited

U.S. PATENT DOCUMENTS

| | | | |
|---|---|---|---|
| 3,903,328 | A | 9/1975 | Burdette et al. |
| 4,908,347 | A | 3/1990 | Denk |
| 5,708,362 | A | 1/1998 | Frese et al. |
| 5,872,500 | A | 2/1999 | Gore |
| 5,903,134 | A | 5/1999 | Takeuchi |
| 5,979,087 | A | 11/1999 | Bell et al. |
| 6,667,435 | B1 | 12/2003 | French et al. |
| 7,477,039 | B2 | 1/2009 | Rodarte |
| 7,538,977 | B2 | 5/2009 | Gider et al. |
| 7,710,071 | B2 | 5/2010 | Rodarte |
| 7,948,208 | B2 | 5/2011 | Partovi et al. |
| 7,952,322 | B2 | 5/2011 | Partovi et al. |
| 8,169,185 | B2 | 5/2012 | Partovi et al. |
| 8,248,025 | B2 | 8/2012 | Sip |
| 8,401,469 | B2 | 3/2013 | Chatterjee |
| 8,497,657 | B2 | 7/2013 | Franks et al. |
| 8,629,652 | B2 | 1/2014 | Partovi et al. |
| 8,629,654 | B2 | 1/2014 | Partovi et al. |
| 8,704,628 | B2 | 4/2014 | Kook |
| 8,823,238 | B2 | 9/2014 | Greaves et al. |
| 8,890,470 | B2 | 11/2014 | Partovi |
| 8,896,264 | B2 | 11/2014 | Partovi |
| 8,901,775 | B2 | 12/2014 | Armstrong et al. |
| 8,901,881 | B2 | 12/2014 | Partovi |
| 8,912,686 | B2 | 12/2014 | Stoner et al. |
| 8,922,162 | B2 | 12/2014 | Park et al. |
| 8,947,047 | B2 | 2/2015 | Partovi et al. |
| 9,106,083 | B2 | 8/2015 | Partovi |
| 9,112,362 | B2 | 8/2015 | Partovi |
| 9,112,363 | B2 | 8/2015 | Partovi |
| 9,112,364 | B2 | 8/2015 | Partovi |
| 9,178,369 | B2 | 11/2015 | Partovi |
| 9,240,270 | B2 | 1/2016 | Wu et al. |
| 2009/0121677 | A1 | 5/2009 | Inoue et al. |
| 2009/0212637 | A1 | 8/2009 | Baarman |
| 2011/0050164 | A1 | 3/2011 | Partovi et al. |
| 2011/0062793 | A1* | 3/2011 | Azancot ..... H01F 38/14 307/116 |
| 2011/0221385 | A1 | 9/2011 | Partovi et al. |
| 2011/0234155 | A1 | 9/2011 | Chen et al. |
| 2012/0112553 | A1 | 5/2012 | Stoner, Jr. et al. |
| 2012/0164849 | A1 | 6/2012 | Lee et al. |
| 2012/0315771 | A1 | 12/2012 | Greig et al. |
| 2013/0049484 | A1 | 2/2013 | Weissentern |
| 2013/0093388 | A1 | 4/2013 | Partovi |
| 2013/0099563 | A1 | 4/2013 | Partovi et al. |
| 2013/0136549 | A1 | 5/2013 | Appel et al. |
| 2013/0249479 | A1 | 9/2013 | Partovi |
| 2013/0260677 | A1 | 10/2013 | Partovi |
| 2013/0271069 | A1 | 10/2013 | Partovi |
| 2013/0285604 | A1 | 10/2013 | Partovi |
| 2013/0285605 | A1 | 10/2013 | Partovi |
| 2013/0300204 | A1 | 11/2013 | Partovi |
| 2014/0008995 | A1 | 1/2014 | Kanno |
| 2014/0103873 | A1 | 4/2014 | Partovi et al. |
| 2014/0132210 | A1 | 5/2014 | Partovi |
| 2014/0191568 | A1 | 7/2014 | Partovi |
| 2014/0217970 | A1 | 8/2014 | Tabata |
| 2014/0306654 | A1 | 10/2014 | Partovi |
| 2015/0130412 | A1 | 5/2015 | Partovi |
| 2015/0145475 | A1 | 5/2015 | Partovi et al. |
| 2015/0270046 | A1 | 9/2015 | Golko et al. |
| 2015/0280483 | A1 | 9/2015 | Golko et al. |
| 2015/0349571 | A1 | 12/2015 | Wagman et al. |
| 2015/0371768 | A1 | 12/2015 | Graham et al. |
| 2016/0006288 | A1 | 1/2016 | Wagman et al. |
| 2016/0064141 | A1 | 3/2016 | Graham et al. |

FOREIGN PATENT DOCUMENTS

| | | |
|---|---|---|
| CN | 102741954 | 10/2012 |
| CN | 102952474 | 3/2013 |
| CN | 203381512 | 1/2014 |
| CN | 203434644 | 2/2014 |
| CN | 203466005 | 3/2014 |
| EP | 0977297 | 2/2000 |
| EP | 1511370 | 3/2007 |
| EP | 1790196 | 7/2012 |
| EP | 2535906 | 12/2012 |
| JP | 2012-119615 A | 6/2012 |
| JP | 2012199370 | 10/2012 |
| JP | 2012222926 | 11/2012 |
| WO | WO03/081976 | 10/2003 |
| WO | WO2009/105615 | 8/2009 |
| WO | WO2012/152980 | 11/2012 |
| WO | WO2013/035282 | 3/2013 |
| WO | 2013/168242 A1 | 11/2013 |
| WO | WO2014/036558 | 3/2014 |

OTHER PUBLICATIONS

International Preliminary Report on Patentability dated Oct. 6, 2016 in PCT/US2015/022222, 15 pages.
Office Action (English Translation) dated Jun. 19, 2017 in Japanese Patent Application No. 2016-572381, 8 pages.
Office Action (English Translation) dated May 24, 2017 in Chinese Patent Application No. 201580015502.4, 10 pages.

* cited by examiner

MAGNETIC SHIELDING IN INDUCTIVE POWER TRANSFER

CROSS-REFERENCE TO RELATED APPLICATIONS

This application is a nonprovisional patent application of and claims the benefit to U.S. Provisional Patent Application No. 61/969,337, filed Mar. 24, 2014 and titled "Magnetic Shielding in Inductive Power Transfer," and this application is a nonprovisional patent application of and claims the benefit to U.S. Provisional Patent Application No. 62/036,685, filed Aug. 13, 2014 and titled "Inductive Power Transmission Housing Shielding," the disclosures of which are hereby incorporated herein by reference in their entireties.

TECHNICAL FIELD

This disclosure relates generally to connectible devices, and more specifically to magnetic shielding in inductive power transfer between connectible devices.

BACKGROUND

Many electronic devices connect to other electronic devices. For example, electronic devices such as portable digital media players, wearable devices, and/or other kinds of portable computing devices may connect to one or more docks in order to charge, transfer data, connect to one or more accessories, such as external input/output devices, and so on. A connection may mechanically couple the electronic devices and/or may electrically couple the electronic devices for the purposes of power and/or data transmission. Using some traditional coupling techniques, it may be difficult to maintain a mechanical coupling between the electronic devices in a way that does not interfere or further facilitates an electrical coupling between the electronic devices.

SUMMARY

The present disclosure includes systems and methods for magnetic shielding in an inductive power transfer system. A first electronic device with a first connection surface and an inductive power transfer receiving coil and first magnetic element positioned adjacent to the first connection surface connects in an aligned position with a second electronic device with a second connection surface and an inductive power transfer transmitting coil and second magnetic element positioned adjacent to the second connection surface. In the aligned position, the first and second electronic devices may be coupled by the first and second magnetic elements and the inductive power transfer transmitting coil may be configured to transmit power to the inductive power transfer receiving coil. The first and/or second magnetic elements and/or the inductive power transfer receiving and/or transmitting coils may be configured to minimize or reduce eddy currents caused in the first and/or second magnetic elements by the inductive power transfer receiving and/or transmitting coils.

The first and/or second magnetic elements and/or the inductive power transfer receiving and/or transmitting coils may be configured in one or more of a variety of different ways to minimize or reduce eddy currents caused in the first and/or second magnetic elements by the inductive power transfer receiving and/or transmitting coils. In some implementations, the inductive power transfer receiving and/or transmitting coils may be inductively coupled in the aligned position. In various implementations, the positioning of the first and/or second magnetic elements and/or the inductive power transfer receiving and/or transmitting coils may be spaced so as to minimize or reduce eddy currents caused in the first and/or second magnetic elements. In one or more implementations, the first and/or second connection surfaces may be formed of one or more nonconductive materials.

In some implementations, the first and/or second magnetic elements may be coated with one or more coatings. Such coatings may be formed of one or more nonconductive and/or magnetically permeable materials. Similarly, the first and/or second magnetic elements may be at least partially covered by one or more shield elements. Such shield elements may be formed of one or more electrically nonconductive materials. The inductive power transfer receiving and/or transmitting coils may also be at least partially covered by one or more shield elements. Such shield elements may be, or function as, a Faraday cage for the inductive power transfer receiving and/or transmitting coils.

In other embodiments, an electronic device may include an inductive coil operable to participate in an inductive power transmission system and a housing or other enclosure. The electronic device may also include one or more magnetic field directing materials (such as diamagnetic material and/or superconductive material) that block magnetic flux of the inductive power transmission from a portion of the housing and/or otherwise shape the flow of the magnetic flux. The magnetic field directing material may also be highly thermally conductive and may operate as a heat spreader. In this way, loss efficiency of the inductive power transmission system may be improved. Temperature increase of the housing may also be prevented and/or mitigated.

In various embodiments, a system for magnetic shielding in inductive power transfer includes a first electronic device and a second electronic device. The first electronic device includes a first connection surface, an inductive power transfer receiving coil positioned adjacent to the first connection surface, and a first magnetic element positioned adjacent to the first connection surface. At least one of the first magnetic element or the inductive power transfer receiving coil is configured to minimize or reduce eddy currents caused in the first magnetic element by the inductive power transfer receiving coil. The second electronic device includes a second connection surface, an inductive power transfer transmitting coil positioned adjacent to the second connection surface, and a second magnetic element positioned adjacent to the second connection surface. The first magnetic element and the second magnetic element connect the first electronic device and the second electronic device in an aligned position and the inductive power transfer transmitting coil is configured to inductively transmit power to the inductive power transfer receiving coil when the first electronic device and the second electronic device are in the aligned position.

In some embodiments, an electronic device includes a first connection surface, an inductive power transfer receiving coil positioned adjacent to the first connection surface, and a first magnetic element positioned adjacent to the first connection surface. At least one of the first magnetic element or the inductive power transfer receiving coil is configured to minimize or reduce eddy currents caused in the first magnetic element by the inductive power transfer receiving coil. The first magnetic element connects the first electronic device to a second magnetic element of a second electronic device in an aligned position. The inductive power transfer receiving coil is configured to inductively receive power from an inductive power transfer transmitting coil of the second electronic device when the first electronic device and the second electronic device are in the aligned position.

In one or more embodiments, an electronic device may include a housing, an inductive coil operable to participate in an inductive power transmission system, and a magnetic field directing material. The magnetic field directing material may block magnetic flux of the inductive power transmission system from a portion of the housing.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

FIG. 9, taken along the section C-C of FIG. 9.

DETAILED DESCRIPTION

Figure 1:
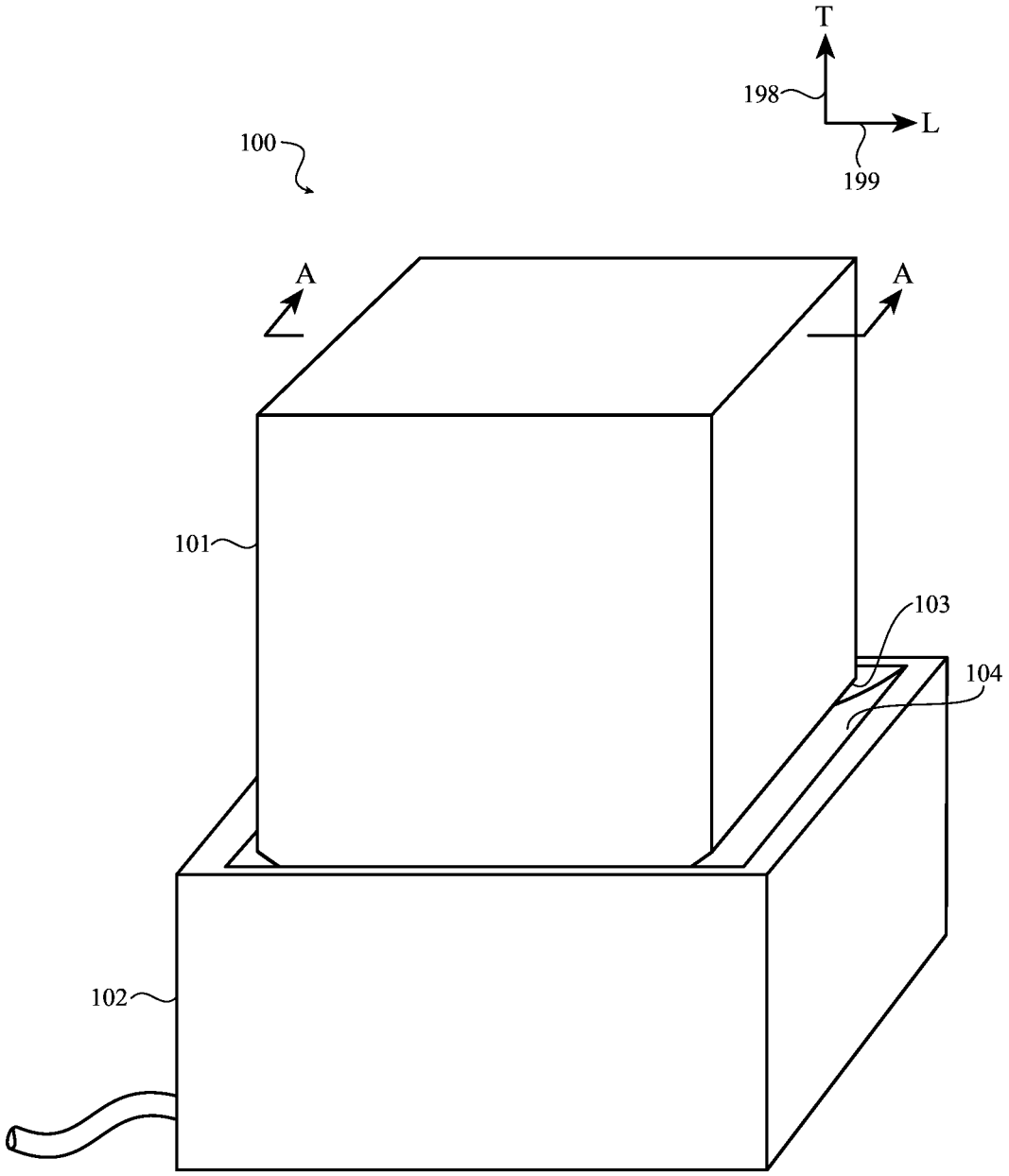
FIG. 1 is a front isometric view illustrating a system for magnetic shielding in inductive power transfer.

The description that follows includes sample systems, methods, and apparatuses that embody various elements of the present disclosure. However, it should be understood that the described disclosure may be practiced in a variety of forms in addition to those described herein.

The present disclosure includes systems and methods for magnetic shielding in inductive power transfer. In some embodiments, a first electronic device is coupled or connected in an aligned position with a second electronic device. The first electronic device may include inductive power transfer receiving coil and a first magnetic element, both positioned adjacent to the first connection surface. Similarly, a second electronic device may include an inductive power transfer transmitting coil and a second magnetic element, both positioned adjacent to the second connection surface. In the aligned position, the first and second electronic devices may be coupled or connected by the first and second magnetic elements (which may be permanent magnets) and the inductive power transfer transmitting coil may be configured to transmit power to the inductive power transfer receiving coil. The first and/or second magnetic elements and/or the inductive power transfer receiving and/or transmitting coils may be configured to minimize or reduce eddy currents caused in the first and/or second magnetic elements by the inductive power transfer receiving and/or transmitting coils. In this way, magnetic connection mechanisms may be utilized without impairing the inductive power transfer and/or causing excessive heat.

The first and/or second magnetic elements and/or the inductive power transfer receiving and/or transmitting coils may be configured in one or more of a variety of different ways to minimize or reduce eddy currents caused in the first and/or second magnetic elements by the inductive power transfer receiving and/or transmitting coils. In some implementations, the inductive power transfer receiving and/or transmitting coils may be inductively coupled in the aligned position. In various implementations, the positioning of the first and/or second magnetic elements and/or the inductive power transfer receiving and/or transmitting coils may be spaced so as to minimize or reduce eddy currents caused in the first and/or second magnetic elements. In one or more implementations, the first and/or second connection surfaces may be formed of one or more nonconductive materials.

In some implementations, the first and/or second magnetic elements may be coated with one or more coatings. Such coatings may be formed of one or more nonconductive and/or magnetically permeable materials such as a polymer including a polyurethane or other type of plastic. The coating may include a combination of a polymer and conductive fibers or particles, a combination of other nonconductive materials and conductive fibers or particles, and/or other such nonconductive and/or magnetically permeable materials.

Similarly, the first and/or second magnetic elements may be at least partially covered by one or more shield elements. Such shield elements may be formed of one or more electrically nonconductive materials, soft magnetic material, ferromagnetic material, ceramic materials, crystalline materials, iron cobalt, and/or other such materials. In some cases, the shield element may be at least partially positioned between the first and/or second magnetic elements and the inductive power transfer receiving and/or transmitting coils, respectively. One or more gaps may be positioned between a surface of the first and/or second magnetic elements that faces the inductive power transfer receiving and/or transmitting coils, respectively, and the portion of the shield element positioned between. Such a shield element may direct a magnetic field of the first and/or second magnetic elements toward the respective connection surface. In some cases, the shield element may be at least partially covered by a nonconductive coating.

The inductive power transfer receiving and/or transmitting coils may also be at least partially covered by one or more shield elements. Such shield elements may be formed of one or more crystalline materials, ceramic materials, soft magnetic material, ferromagnetic material, iron silicon, and/or other such materials and/or may function as a Faraday cage for the inductive power transfer receiving and/or transmitting coils. Such shield elements may be at least partially positioned between the inductive power transfer receiving and/or transmitting coils and the first and/or second magnetic elements, respectively.

In various cases, the first and/or second magnetic elements may be positioned in the center of the inductive power transfer receiving and/or transmitting coils, respectively, and/or along an axis running through the center of the inductive power transfer receiving and/or transmitting coils.

In other embodiment, an electronic device may include an inductive coil operable to participate in an inductive power transmission system, a housing or other enclosure, and one or more magnetic field directing materials. The magnetic field directing material may block magnetic flux of the inductive power transmission system from a portion of the housing, shaping the flow of the magnetic flux. In this way, loss efficiency of the inductive power transmission system may be improved and/or temperature increase of the housing may be prevented and/or mitigated.

As used herein, a "lateral magnetic force" may be used to refer to a magnetic force that moves one or both of the devices in a lateral or an X- or a Y-direction with respect to one another. In some cases, the lateral magnetic force may refer to a resistance to a shear or lateral force between the devices. In some cases, some Z-direction (height) motion may occur as a byproduct of an alignment of the adjacent surfaces with respect to each other, particularly if the adjacent surfaces are curved. Lateral magnetic force is more fully discussed with respect to FIGS. 1-3 below. As used herein, a "transverse magnetic force" refers to a magnetic force that attracts the devices toward each other in a transverse or Z-direction, which may operate to center and align the two devices as well as resist a separation or expansion of a gap between the two devices. Transverse magnetic force is more fully discussed with respect to FIGS. 1-3 below. As discussed herein, lateral magnetic force and transverse magnetic force may be components of the same, single magnetic field. Both may vary based on the positions of the magnetic elements.

FIG. 1 is a front isometric view illustrating a system for magnetic shielding in inductive power transfer. The system 100 may include a first electronic device 101 and a second electronic device 102. Although FIG. 1 illustrate the first electronic device 101 as a cordless electronic device of a particular shape and the second electronic device 102 as a dock for the cordless electronic device, it is understood that this is merely an example. In various implementations, either the first electronic device 101 or the second electronic device 102 may be any kind of electronic device such as a laptop computer, a tablet computer, a mobile computing device, a smart phone, a cellular telephone, a digital media player, a dock that connects to another electronic device for the purposes of charging and/or connecting the electronic device to one or more external components, and/or any other such electronic device.

As illustrated in FIG. 1, the first electronic device 101 includes a first connection surface 103 that is operable to contact a second connection surface 104 of the second electronic device 102. As such, the first and second electronic devices 101, 102 may be positionable with respect to each other in at least lateral 199 and transverse 198 relative directions.

Figure 2:
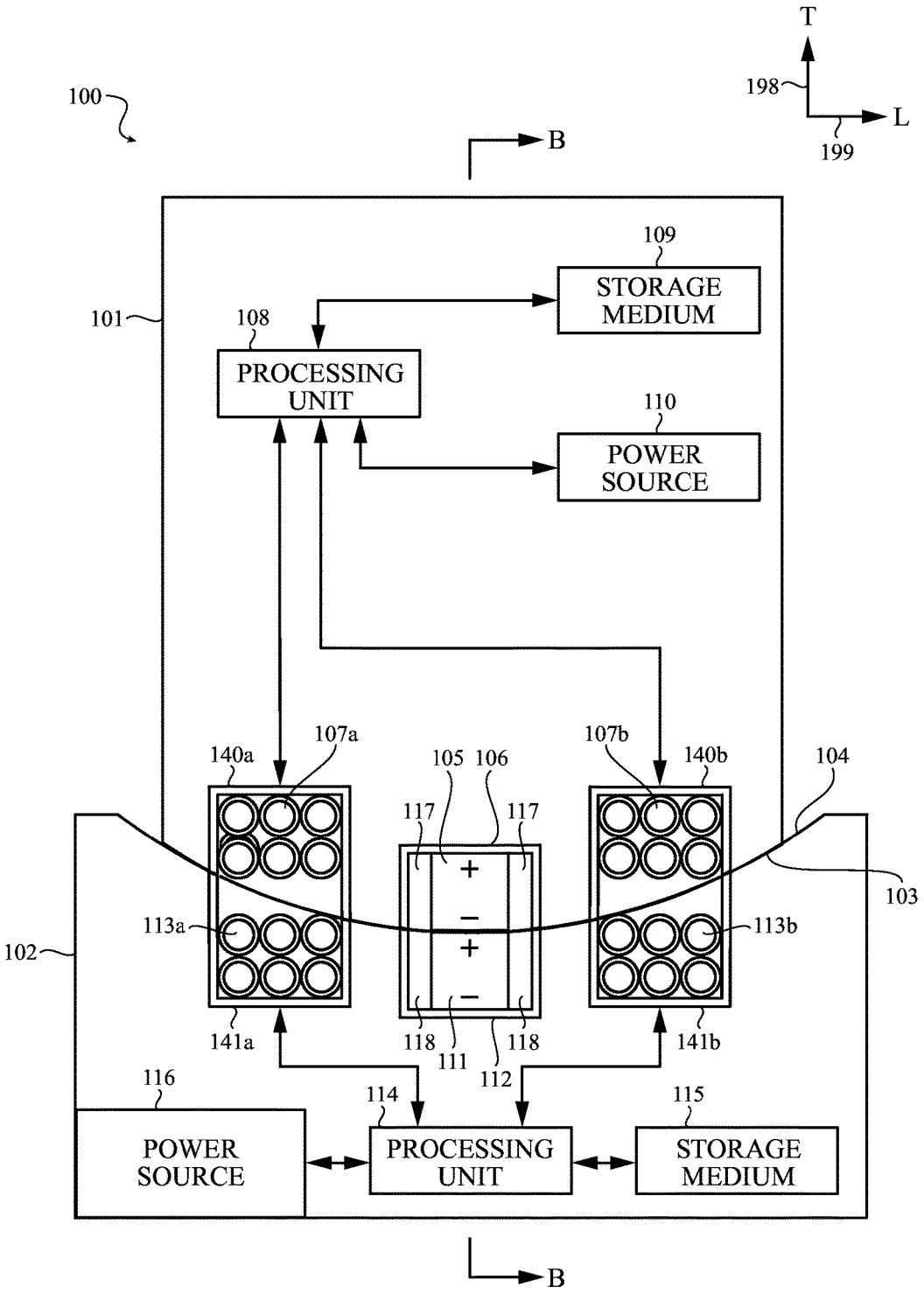
FIG. 2 is a cross-sectional front plan view of the system of FIG. 1 taken along section A-A of FIG. 1 illustrating the connectible electronic devices in an aligned position.
Figure 3:
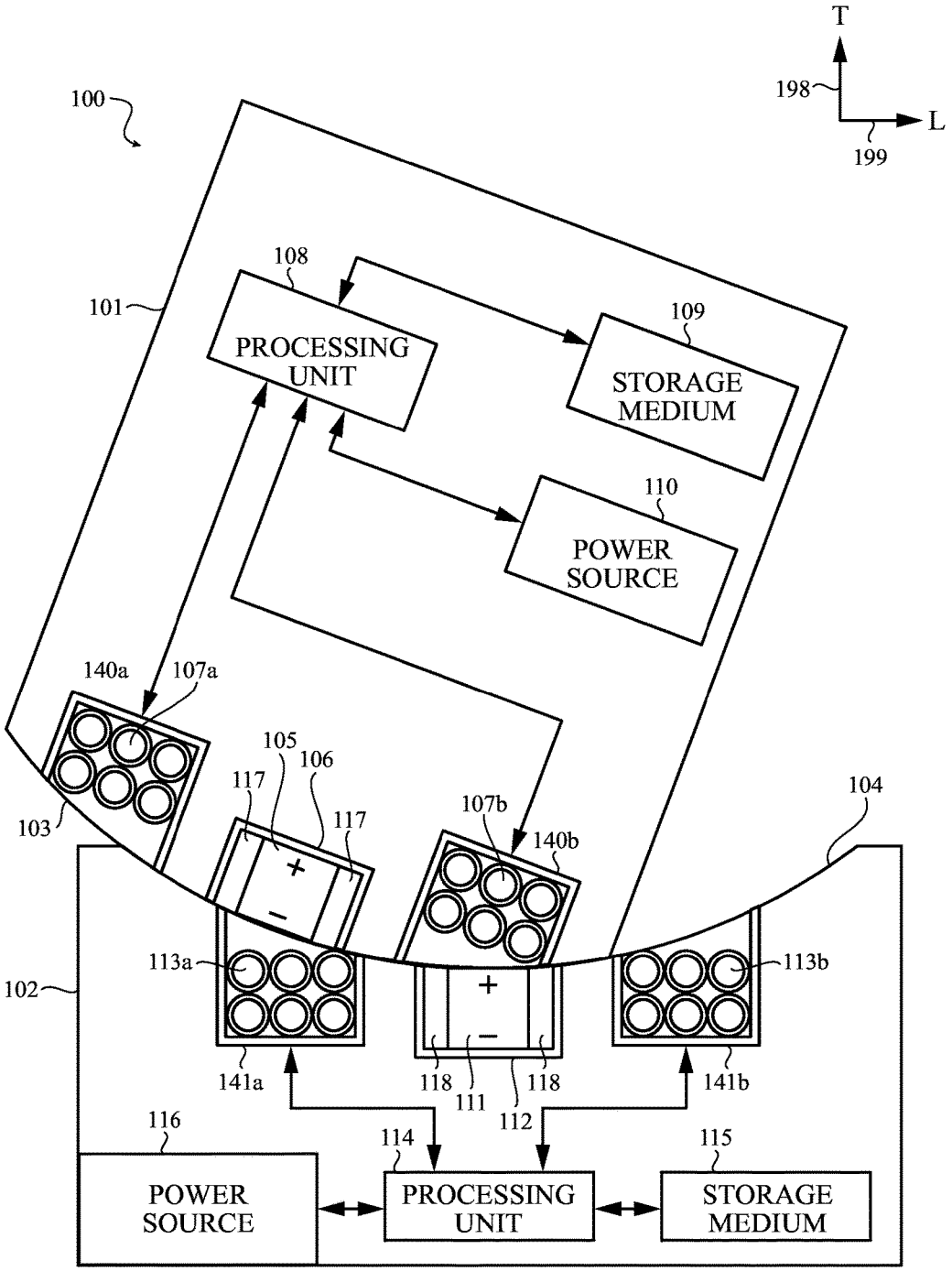
FIG. 3 illustrates the system of FIG. 2 showing the connectible electronic devices in one possible contact position.
Figure 4:
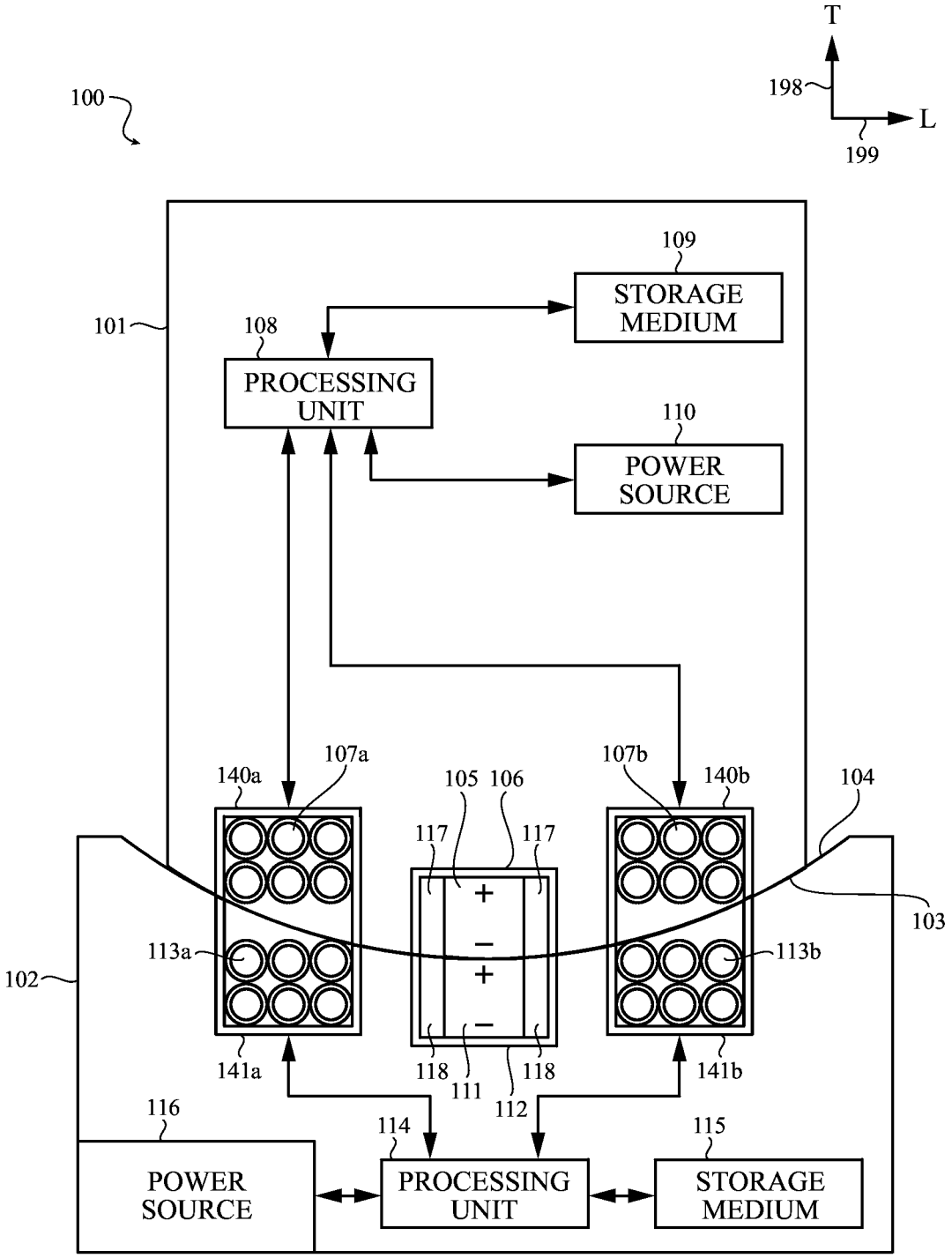
FIG. 4 is a cross sectional side view of the system of FIG. 2 taken along section B-B of FIG. 2.

FIG. 2 is a cross-sectional front plan view of the system 100 of FIG. 1 taken along section A-A of FIG. 1 illustrating the first and second connectible electronic devices 101 and 102 in an aligned position. FIG. 3 illustrates the system of FIG. 2 showing the first and second connectible electronic devices 101 and 102 in one possible contact position. The first and second connection surfaces 103 and 104 may contact at any number of different points. As such, any number of different contact positions may be possible, of which FIG. 3 is an example. However, the first and second connectible electronic devices 101 and 102 may have a single aligned position, illustrated in FIG. 2, where a first magnetic element 105 connects with a second magnetic element 111 and an inductive power transfer transmitting coil 113*a* and 113*b* (cross-sectional portions of a single coil) is aligned with an inductive power transfer receiving coil 107*a* and 107*b* (cross-sectional portions of a single coil). In the aligned position, the first and second electronic devices 101 and 102 may be participants in an inductive power transfer system where the second electronic device 102 functions as a charging dock for the first electronic device 101 by inductively transmitting power to the first electronic device 101, which the first electronic device 101 stores in the power source 110. FIG. 4 is a cross-sectional side view of the system of FIG. 2 taken along section B-B of FIG. 2.

As illustrated in FIG. 2, the first electronic device 101 may include one or more first magnetic elements 105 (which may be a permanent magnet and may include a shield element 106), inductive power transfer receiving coil 107*a* and 107*b* (cross-sectional portions of a single coil that respectively include shield elements 140*a* and 140*b*), processing units 108, one or more non-transitory storage media 109 (which may take the form of, but is not limited to, a magnetic storage medium; optical storage medium; magneto-optical storage medium; read only memory; random access memory; erasable programmable memory; flash memory; and so on), and/or one or more power sources 110 (such as one or more batteries). The processing unit 108 may execute one or more instructions stored in the non-transitory storage medium 109 to perform one or more first electronic device operations such as one or more receiving operations utilizing the receiving component, communication operations, calculation operations, storage operations, input/output operations, time operations, charging operations, and so on.

Similarly, the second electronic device 102 may include one or more second magnetic elements 111 (which may be a permanent magnet and may include a shield element 112), inductive power transfer transmitting coil 113*a* and 113*b* (cross-sectional portions of a single coil that respectively include shield elements 141*a* and 141*b*), processing units 114, one or more non-transitory storage media 115, and/or one or more power sources 116 (such as one or more alternating current or direct current power sources). The processing unit 114 may execute one or more instructions stored in the non-transitory storage medium 115 to perform one or more second electronic device operations such as one or more transmitting operations utilizing the transmitting component, calculation operations, storage operations, and so on.

When the first and second electronic devices 101 and 102 are placed into one of the possible contact positions (such as shown in FIG. 3), lateral 199 magnetic force between the first and second magnetic elements 105 and 111 may bring the electronic devices into the aligned position (shown in FIG. 2) where transverse 198 magnetic force between the first and second magnetic elements may connect the two devices. In the aligned position, the inductive power transfer transmitting coil 113*a* and 113*b* may be configured to inductively transmitting power to the inductive power transfer receiving coil 107*a* and 107*b*.

As illustrated in FIG. 2, the first magnetic element 105 may be positioned within the center, or along an axis (corresponding to the transverse direction 198 in this example implementation) running through the center, of the inductive power transfer receiving coil 107*a* and 107*b*. Similarly, the second magnetic element 111 may be positioned within the center, or along an axis (corresponding to the transverse direction 198 in this example implementation) running through the center, of the inductive power transfer transmitting coil 113*a* and 113*b*.

When conductive materials, such as magnetic elements, are positioned within the induction field of a transmitting coil and receiving coil of an inductive power transfer system, eddy currents may be formed in the conductive materials. Such eddy currents may result in less current being received by the receiving coil, thus less inductive power transfer system efficiency. Such eddy currents may also cause undesired heating in the conductive materials. As such, the first and/or second magnetic elements and/or the inductive power transfer transmitting and/or receiving coils may be configured to minimize or reduce eddy currents caused in the first and/or second magnetic elements by the inductive power transfer transmitting and/or receiving coils.

The first and/or second magnetic elements (105, 111) and/or the inductive power transfer transmitting and/or receiving coils (113*a-b*, 107*a-b*) may be configured to minimize or reduce eddy currents in a variety of different ways. As illustrated, the inductive power transfer transmitting coil 113*a* and 113*b* and the inductive power transfer receiving coil 107*a* and 107*b* may be inductively coupled in the aligned position. Transmitting and receiving coils in an inductive power transfer system may be inductively coupled when they are centered with respect to each other and sufficiently adjacent that the receiving coil is within the majority of the inductive current field generated by the transmitting coil. This results in more of the inductive current field influencing the receiving coil, resulting in increased transmission efficiency and less generated heat, as opposed to being available for influencing other conductive materials and thus reducing transmission efficiency and more generated heat. As such, tightly coupling the coils may reduce eddy currents that might otherwise be caused in one or more of the magnetic elements.

As also illustrated in FIG. 2, the inductive power transfer transmitting coil 113*a* and 113*b*, the inductive power transfer receiving coil 107*a* and 107*b*, and the first and second magnetic elements 105 and 111 may be spaced in relation to each other in order to minimize creation of eddy currents in the first and/or second magnetic elements. Positioning of either magnetic element too closely, such as immediately adjacent, to either coil may cause creation of eddy currents. However, spacing as illustrated may reduce the eddy currents that may otherwise be created by proximity of the magnetic elements and the coils.

In various implementations, the first and/or second connection surfaces 103 and 104 may be formed of one or more nonconductive materials. This may prevent formation of eddy currents in the connection surfaces and may further increase transmission efficiency and reduce generated heat.

In some implementations, the first and second magnetic elements 105 and 111 may include shield elements 106 and 112, respectively. Each magnetic element may have a face surface and an opposite surface that are joined by at least two side surfaces wherein the face surface faces the respective connection surface. The respective shield element may at least partially cover the opposite surface and the two side surfaces. A gap 117 or 118 may be present between the respective shield element and the at least two side surfaces.

Such shield elements may be formed of one or more electrically nonconductive materials, soft magnetic material, ferromagnetic material, ceramic materials, crystalline materials, iron cobalt, and/or other such materials. In some cases, a soft magnetic material may be electrically conductive, such as a nonconductive ceramic material that includes ferrous metal fibers or particles suspended therein. As the fibers or particles are separated by nonconductive material, the combination may itself be nonconductive even though the presence of the ferrous metal fibers or particles may cause the combination to be a soft magnetic material. In various cases, whether formed of a conductive material, nonconductive material, or a combination thereof, such a shield element may be at least partially coated with a nonconductive coating such as those discussed in further detail below.

The shield element 106 or 112 may be at least partially positioned between the first or second magnet 105 and 111 and the inductive power transfer transmitting coil 113*a* and 113*b* or the inductive power transfer receiving coil 107*a* and 107*b*, respectively. The gap 117 or 118 may be positioned between a surface of the respective magnetic element and the respective coil.

The shield element 106 or 112, which may be formed of ferromagnetic material, a soft magnetic material, or other material that demonstrates the ability to easily become magnetic such as iron cobalt, may direct a magnetic field of the magnetic element in a direction of the connection surface. Such direction of the magnetic field may enable use of smaller magnetic elements than would otherwise be possible and may prevent the magnetic fields of the first and/or second magnetic elements 105 and 111 from interfering with (thus causing eddy currents in the magnetic elements) the inductive current field between the inductive power transfer transmitting coil 113*a* and 113*b* and the inductive power transfer receiving coil 107*a* and 107*b*.

Although the shielding elements 106 and 112 are illustrated as having a single, solid structure, it is understood that this is an example. In some cases, one or more of the shielding elements may be formed to have one or more "cutouts," or intermittent breaks in the material of the shield. Such cutouts may interrupt electrical conductivity through portions of such a shield and may further minimize the formation of eddy currents while still allowing for a highly permeable volume.

Figure 5A:
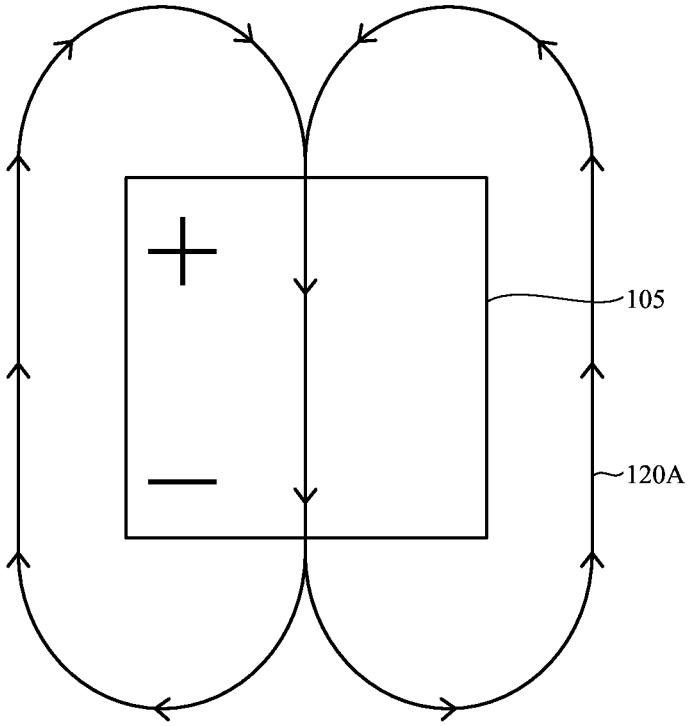
FIG. 5A illustrates a magnetic field of the first magnetic element of FIG. 2 removed from the first electronic device and the shield element.

FIG. 5A illustrates a magnetic field 120A of the first magnetic element 105 of FIG. 2 removed from the first electronic device 101 and the shield element 106. By way of contrast, FIG. 5B illustrates the magnetic field 120A of the first magnetic element including the shield element of FIG.

2 removed from the first electronic device. As can be seen by comparing FIGS. 5A and 5B, the inclusion of the shield element may direct the magnetic field 120A toward the first connection surface (item 103 in FIGS. 2-4).

Figure 5B:
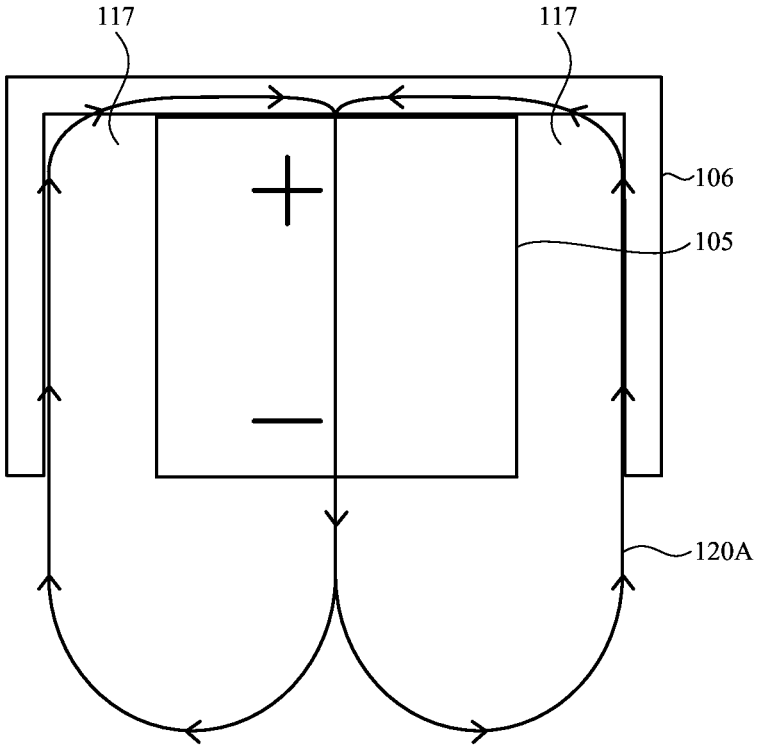
FIG. 5B illustrates the magnetic field of the first magnetic element including the shield element of FIG. 2 removed from the first electronic device.

Although FIGS. 5A and 5B illustrate the magnetic field 120A as circulating in one sample direction, it is understood that this is an example. In other embodiments, the magnetic field 120A may be reversed without departing from the scope of the present disclosure.

In various implementations, the inductive power transfer transmitting coil 113*a* and 113*b* or the inductive power transfer receiving coil 107*a* and 107*b* may include shield elements 140*a* and 140*b* or 141*a* and 141*b*, respectively. Each coil may have a collective face surface and an collective opposite surface that are joined by at least two collective side surfaces wherein the collective face surface faces the respective connection surface. The respective shield element may at least partially cover the collective opposite surface and the collective two side surfaces.

As illustrated, shield elements 140*a* and 140*b* or 141*a* and 141*b* may be at least partially positioned between the inductive power transfer transmitting coil 113*a* and 113*b* or the inductive power transfer receiving coil 107*a* and 107*b* and the first or second magnetic elements 105 and 111, respectively. These shield elements may function as a Faraday cage, blocking electromagnetic radiation. As such, these shield elements may block one or more of the magnetic elements from the inductive current field between the inductive power transfer transmitting coil and the inductive power transfer receiving coil, thus reducing eddy currents that may otherwise be caused in the magnetic elements. Such shield elements may be formed of one or more crystalline materials, ceramic materials, soft magnetic material, ferromagnetic materials, iron silicon, and/or other such materials.

Although the shielding elements 140*a* and 140*b* or 141*a* and 141*b* are illustrated as having a single, solid structure, it is understood that this is an example. In some cases, one or more of the shielding elements may be formed to have one or more "cutouts," or intermittent breaks in the material of the shield. Such cutouts may interrupt electrical conductivity through portions of such a shield and may further minimize the formation of eddy currents while still allowing for a highly permeable volume.

Figure 7:
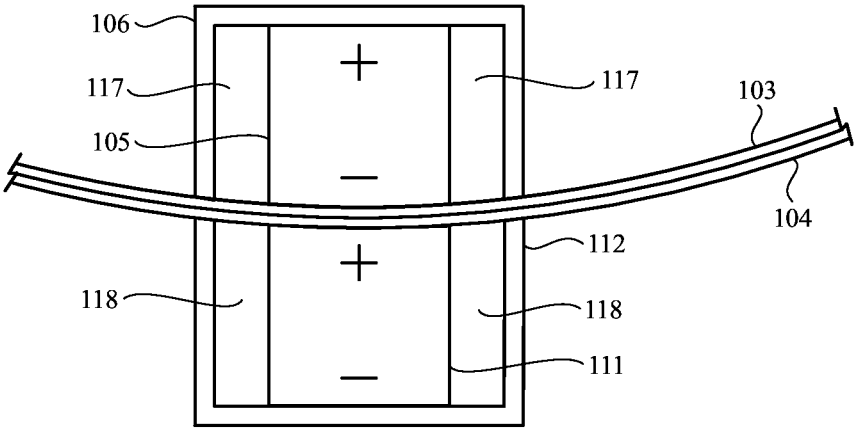
FIG. 7 is a close up view of the first and second magnetic elements of an alternative embodiment of the first and second electronic devices in the aligned position.

In some implementations, one or more of the first and/or second magnetic elements 105 and 111 may be at least partially coated with one or more nonconductive coatings. FIG. 7 illustrates an example implementation that includes such nonconductive coatings 131 and 132. Such nonconductive coatings may reduce eddy currents that may otherwise be caused in the first and/or second magnetic element by the inductive power transfer transmitting coil 113*a* and 113*b* or the inductive power transfer receiving coil 107*a* and 107*b*.

Such coatings may be formed of one or more nonconductive and/or magnetically permeable materials such as polyurethane, plastic, a combination of polyurethane and/or plastic and conductive fibers or particles, a combination of other nonconductive materials and conductive fibers or particles, and/or other such nonconductive and/or magnetically permeable materials. For example, in cases where ferrous metal fibers or particles are combined with nonconductive materials, the separation of the ferrous fibers or particles by nonconductive material may result in the combination being nonconductive even though the presence of the ferrous metal fibers or particles may cause the combination to be magnetically permeable.

Returning to FIG. 2, although the inductive power transfer receiving coil 107*a* and 107*b* is shown as being generally parallel to a top surface of the first electronic device 101 and the inductive power transfer transmitting coil 113*a* and 113*b* is shown as being generally parallel to a bottom surface of the second electronic device 102 such that they are not flush aligned with the first and second connection surfaces 103 and 104, it is understood that this is an example. In other implementations, the inductive power transfer receiving coil 107*a* and 107*b* may be flush with the first connection surface and the inductive power transfer transmitting coil 113*a* and 113*b* may be flush with the second connection surface without departing from the scope of the present disclosure. In such an implementation, the inductive power transfer receiving coil 107*a* and 107*b* and the inductive power transfer transmitting coil 113*a* and 113*b* may be angled with respect to the top surface of the first electronic device and/or the bottom surface of the second electronic device.

Figure 6:
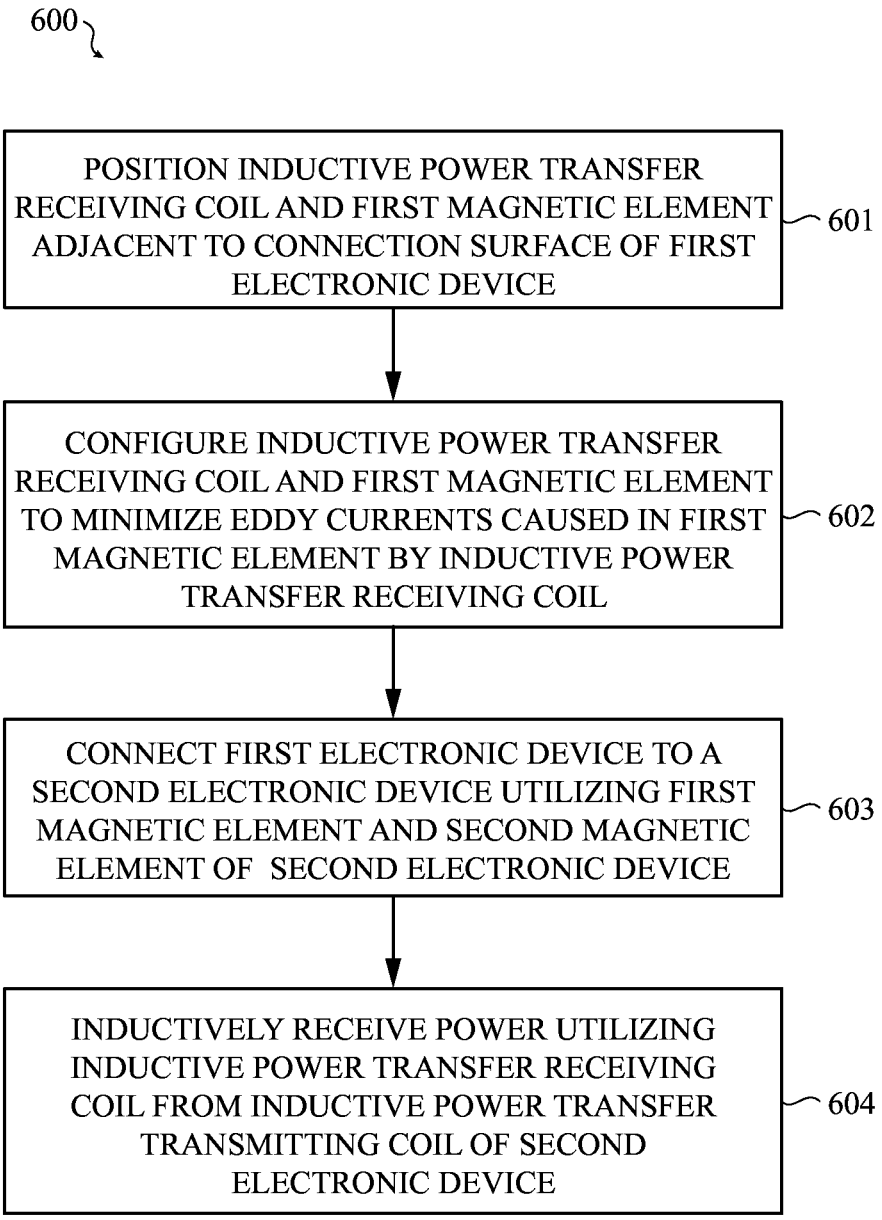
FIG. 6 is a method diagram illustrating a method for magnetic shielding in inductive power transfer. This method may be performed by the system of FIG. 1.

FIG. 6 is a method diagram illustrating a method 600 for magnetic shielding in inductive power transfer. This method may be performed, for example, by the system of FIG. 1. The flow may begin at block 601 where an inductive power transfer receiving coil and first magnetic element of a first electronic device may be positioned adjacent to a connection surface of the first electronic device. The flow may then proceed to block 602 where the inductive power transfer receiving coil and the first magnetic element may be configured to minimize or reduce eddy currents caused in the first magnetic element by the inductive power transfer receiving coil.

At block 603, the first electronic device may be coupled or connected to a second electronic device utilizing the first magnetic element and the second magnetic element of the second electronic device. The flow may then proceed to block 604 where power may be inductively received utilizing inductive power transfer receiving coil from inductive power transfer transmitting coil of the second electronic device.

Although the method 600 is illustrated and described above as including particular operations performed in a particular order, it is understood that this is an example. In various implementations, various configurations of the same, similar, and/or different operations may be performed without departing from the scope of the present disclosure.

For example, block 602 is shown and described above as configuring the inductive power transfer receiving coil and the first magnetic element may to minimize or reduce eddy currents caused in the first magnetic element by the inductive power transfer receiving coil. However, in some implementations, either the inductive power transfer receiving coil or first magnetic element may be so configured. Further, in various implementations, the inductive power transfer receiving and/or transmitting coils and/or the first and/or second magnetic elements may be configured to minimize or reduce eddy currents caused in either magnetic element caused by either of the coils without departing from the scope of the present disclosure.

Figure 8:
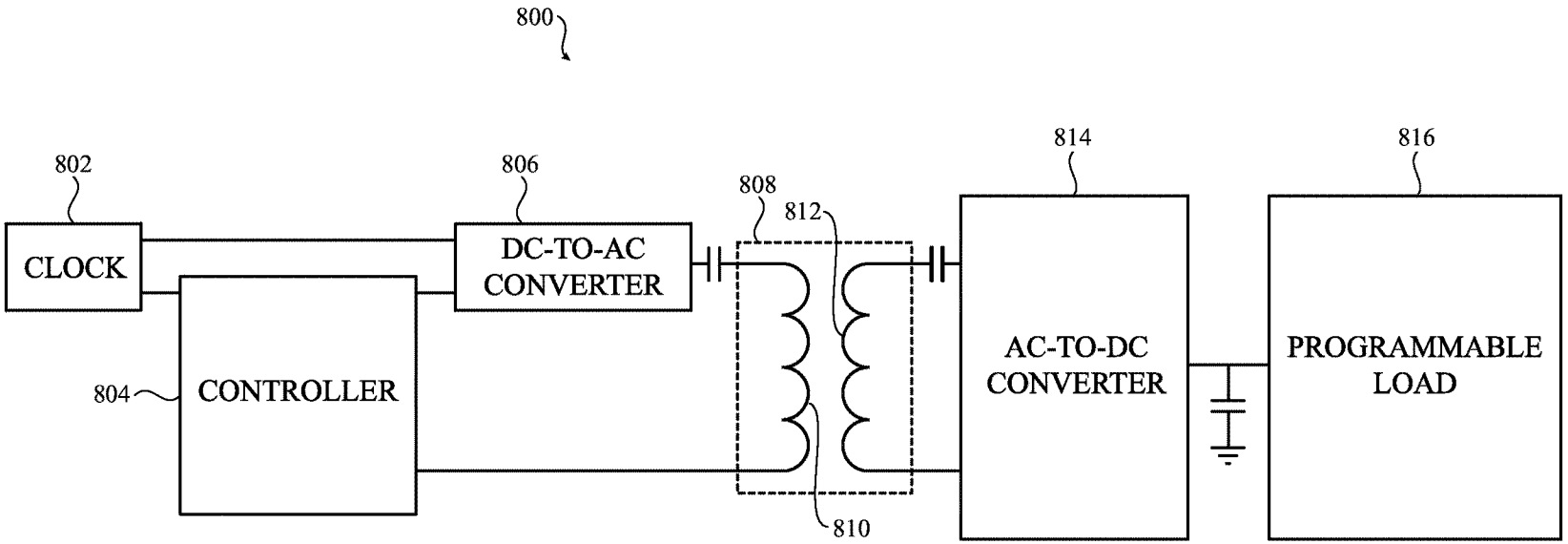
FIG. 8 is a simplified block diagram of an example frequency controlled inductive charging system. The example frequency controlled inductive charging system may be utilized with the system of FIG. 2.

Referring now to FIG. 8, a simplified block diagram of an example frequency controlled inductive charging system 800 is shown that may be utilized with inductive power transfer transmitting coil (e.g., 113*a* and 113*b* of FIGS. 2-4) and inductive power transfer receiving coil (e.g., 107*a* and 107*b* of FIGS. 2-4). The inductive charging system 800 includes a clock circuit 802 operatively connected to a controller 804 and a direct-current converter 806. The clock circuit 802 can generate the timing signals for the inductive charging system 800.

The controller 804 may control the state of the direct-current converter 806. In one embodiment, the clock circuit 802 generates periodic signals that are used by the controller 804 to activate and deactivate switches in the direct-current converter 806 on a per cycle basis. Any suitable direct-current converter 806 can be used in the inductive charging system 800. For example, in one embodiment, an H bridge may be used in the direct-current converter 806. H bridges are known in the art, so only a brief summary of the operation of an H bridge is described herein.

The controller 804 controls the closing and opening of four switches S1, S2, S3, S4 (not illustrated). When switches S1 and S4 are closed for a given period of time and switches S2 and S3 are open, current may flow from a positive terminal to a negative terminal through a load. Similarly, when switches S2 and S3 are closed for another given period of time while switches S1 and S4 are open, current flows from the negative terminal to the positive terminal. This opening and closing of the switches produces a time-varying current by repeatedly reversing the direction of the current through the load same load. In an alternate embodiment, an H bridge may not be required. For example, a single switch may control the flow of current from the direct-current converter 806. In this manner, the direct-current converter 806 may function as a square wave generator.

The time-varying signal or square wave signal produced by the direct-current converter 806 may be input into a transformer 808. Typically, a transformer such as those used in the above-referenced tethered charging systems includes a primary coil coupled to a secondary coil, with each coil wrapped about a common core. However, an inductive charging system as described herein includes a primary and a secondary coil separated by an air gap and the respective housings containing each coil. Thus, as illustrated, transformer 808 may not necessarily be a physical element but instead may refer to the relationship and interface between two inductively proximate electromagnetic coils such as a primary coil 810 (which may be the transmitting component 113*a* and 113*b* of the system 100 of FIG. 2) and a secondary coil 812 (which may be the receiving component 107*a* and 107*b* of the system 100 of FIG. 2).

The foregoing is a simplified description of the transmitter and its interaction with a secondary coil 812 of an inductive power transfer system. The transmitter may be configured to provide a time-varying voltage to the primary coil 810 in order to induce a voltage within the secondary coil 812. Although both alternating currents and square waves were pointed to as examples, one may appreciate that other waveforms are contemplated. In such a case, the controller 804 may control a plurality of states of the direct-current converter 806. For example, the controller 804 may control the voltage, current, duty cycle, waveform, frequency, or any combination thereof.

The controller 804 may periodically modify various characteristics of the waveforms applied to the primary coil 810 in order to increase the efficiency of the operation of the power transmitting circuitry. For example, in certain cases, the controller 804 may discontinue all power to the primary coil 810 if it is determined that the secondary coil 812 may not be inductively proximate the primary coil 810. This determination may be accomplished in any number of suitable ways. For example, the controller 804 may be configured to detect the inductive load on the primary coil 810. If the inductive load falls below a certain selected threshold, the controller 804 may conclude that the secondary coil 812 may not be inductively proximate the primary coil 810. In such a case, the controller 804 may discontinue all power to the primary coil 810.

In other cases, the controller 804 may set the duty cycle to be at or near a resonance frequency of the transformer 808. In another example, the period of the waveform defining the active state of the duty cycle (i.e., high) may be selected to be at or near the resonance frequency of the transformer 808. One may appreciate that such selections may increase the power transfer efficiency between the primary coil 810 and the secondary coil 812.

In an alternate example, the controller 804 may discontinue all power to the primary coil 810 if a spike in inductive load is sensed. For example, if the inductive load spikes at a particular rate above a certain selected threshold the controller 804 may conclude that an intermediate object may be placed inductively proximate the primary coil 810. In such a case, the controller 804 may discontinue all power to the primary coil 810.

In still further examples, the controller 804 may modify other characteristics of the waveforms applied to the primary coil 810. For example, if the receiver circuitry requires additional power, the controller 804 may increase the duty cycle of the waveform applied to the primary coil 810. In a related example, if the receiver circuitry requires less power, the controller 804 may decrease the duty cycle of the waveform applied to the primary coil 810. In each of these examples, the time average power applied to the primary coil 810 may be modified.

In another example, the controller 804 may be configured to modify the magnitude of the waveform applied to the primary coil 810. In such an example, if the receiver circuitry requires additional power, the controller 804 may amplify the maximum voltage of the waveform applied to the primary coil 810. In the related case, the maximum voltage of the waveform may be reduced if the receiver circuitry requires less power.

With regard to FIG. 8, and as noted above, the transmitter portion of the inductive power transfer system may be configured to provide a time-varying signal to the primary coil 810 in order to induce a voltage within the secondary coil 812 in the receiver through inductive coupling between the primary coil 810 and the secondary coil 812. In this manner, power may be transferred from the primary coil 810 to the secondary coil 812 through the creation of a varying magnetic flux by the time-varying signal in the primary coil 810.

The time-varying signal produced in the secondary coil 812 may be received by an direct-current converter 814 that converts the time-varying signal into a DC signal. Any suitable direct-current converter 814 can be used in the inductive charging system 800. For example, in one embodiment, a rectifier may be used as an direct-current converter. The DC signal may then be received by a programmable load 816.

In some embodiments, the receiver direct-current converter 814 may be a half bridge. In such examples, the secondary coil 812 may have an increased number of windings. For example, in some embodiments, the secondary coil may have twice as many windings. In this manner, as one may appreciate, the induced voltage across the secondary coil 812 may be reduced by half, effectively, by the half bridge rectifier. In certain cases, this configuration may require substantially fewer electronic components. For example, a half bridge rectifier may require half as many transistors as a full wave bridge rectifier. As a result of fewer electronic components, resistive losses may be substantially reduced.

In certain other embodiments, the receiver may also include circuitry to tune out magnetizing inductance present within the transmitter. As may be known in the art, magnetizing inductance may result in losses within a transformer formed by imperfectly coupled coils. This magnetizing inductance, among other leakage inductance, may substantially reduce the efficiency of the transmitter. One may further appreciate that because magnetizing inductance may be a function of the coupling between a primary and secondary coil, that it may not necessarily be entirely compensated within the transmitter itself. Accordingly, in certain embodiments discussed herein, tuning circuitry may be included within the receiver. For example, in certain embodiments, a capacitor may be positioned parallel to the programmable load 816.

In still further examples, a combination of the above-referenced sample modifications may be made by the controller. For example, the controller 804 may double the voltage in addition to reducing the duty cycle. In another example, the controller may increase the voltage over time, while decreasing the duty cycle over time. One may appreciate that any number of suitable combinations are contemplated herein.

Other embodiments may include multiple primary coils 810. For example, if two primary coils are present, each may be activated or used independently or simultaneously. In such an embodiment, the individual coils may each be coupled to the controller 804. In further examples, one of the several individual primary coils 810 may be selectively shorted. For example, a switch may be positioned in parallel to the coil such that when the switch is off current may run through the inductor. On the other hand, when the switch is on, no current will run through the coil. The switch may be any suitable type of manual, solid state, or relay based switch. In this manner, the amount of increase in current through each of the several coils may be electively controlled. For example, in a circumstance with a high inductive load, the switch may be turned off to include the coil in the circuit with the primary coil 810.

Figure 9:
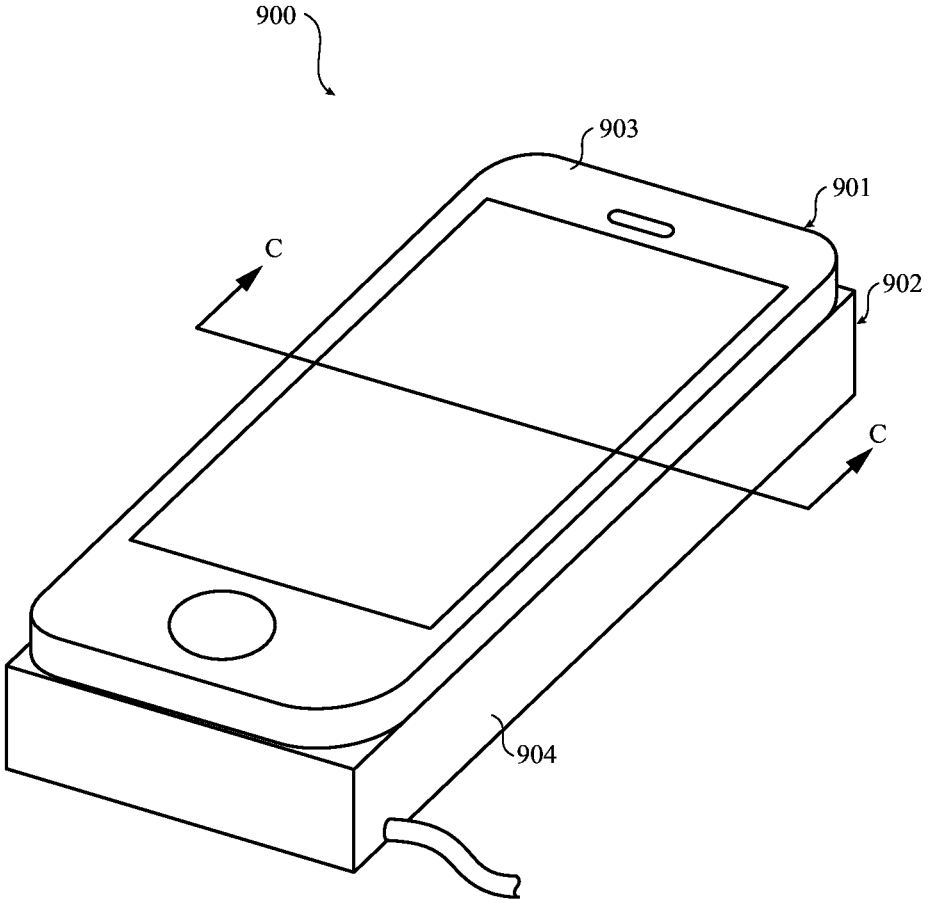
FIG. 9 is a simplified isometric view of an inductive power transmission system in accordance with another embodiment from which a number of components have been omitted for purposes of clarity.

FIG. 9 is a simplified isometric view of an inductive power transmission system 900 in accordance with another embodiment from which a number of components have been omitted for purposes of clarity. As illustrated, a first electronic device 901 may be operable to receive power inductively transmitted from a second electronic device 902; the first electronic device may store the power in one or more batteries (not shown). The first electronic device may include a housing 903 and the second electronic device may include a housing 904.

The first electronic device 901 is illustrated as a smart phone and the second electronic device 902 is illustrated as a charging dock for the smart phone. However, it is understood that this is an example. In various implementations the first and/or second electronic devices may be any kind of electronic devices. Further, although the first electronic device 901 is described as receiving power inductively transmitted from the second electronic device 902, it is understood that this is an example and that other transmission configurations may be utilized without departing from the scope of the present disclosure.

Figure 10A:
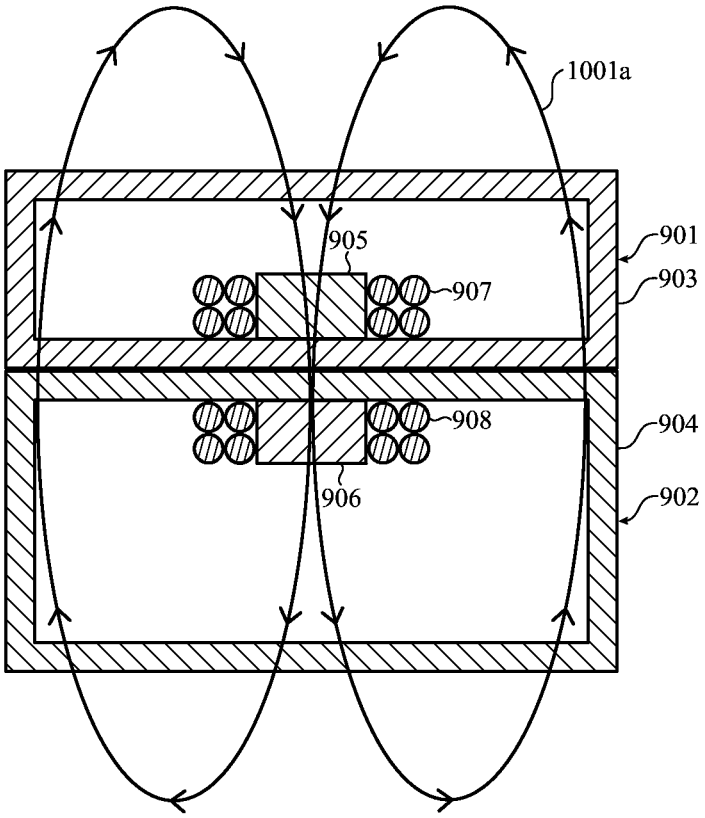
FIG. 10A is a cross-sectional side view of a first implementation of the inductive power transmission system of FIG. 9, taken along the section C-C of FIG. 9.

FIG. 10A is a cross-sectional side view of a first implementation of the inductive power transmission system 900 of FIG. 9, taken along the section C-C of FIG. 9. As illustrated, the first electronic device 901 may include an inductive receive coil 907 and an alignment magnet 905. As also illustrated, the second electronic device 902 may include an inductive transmit coil 908 and an alignment magnet 906. The alignment magnets 905 and 906 may be operable to assist in aligning the inductive transmit and receive coils for inductive power transmission and to keep the coils aligned during transmission.

As illustrated, magnetic flux 1001*a* may be generated by and flow through the inductive transmit and receive coils 907 and 908 during inductive power transmission. Such magnetic flux 1001 may interact with the housing 903 and/or the housing 904. This interaction may cause eddy currents to form in the housing 903 and/or the housing 904. Such eddy currents may cause efficiency losses in the inductive power transmission and/or may increase the temperature of one or more portions of the housing 903 and/or the housing 904.

Figure 10B:
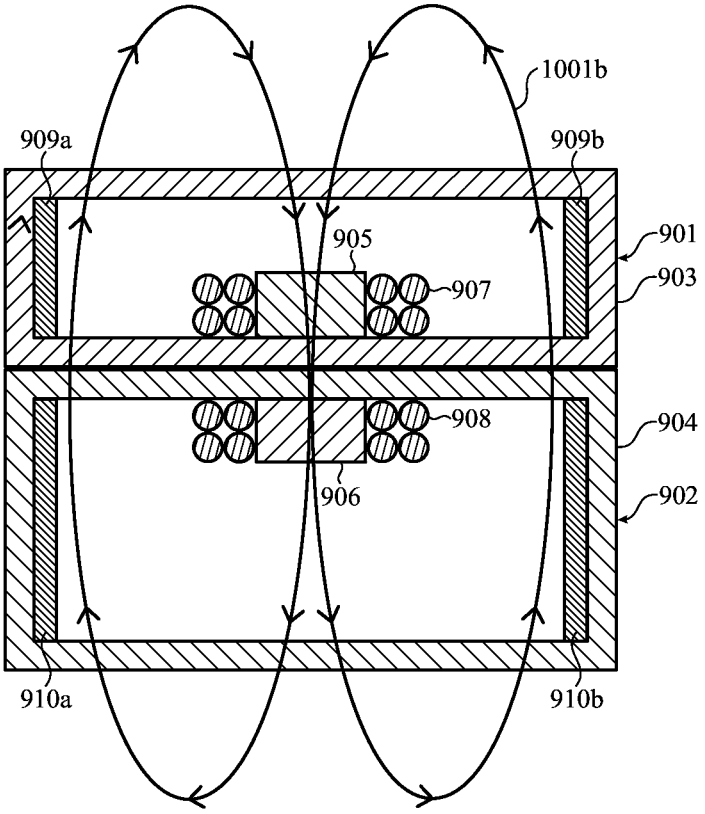
FIG. 10B is a cross-sectional side view of a second implementation of the inductive power transmission system of FIG. 9, taken along the section C-C of FIG. 9.

FIG. 10B is a cross-sectional side view of a second implementation of the inductive power transmission system 900 of FIG. 9, taken along the section C-C of FIG. 9. To contrast with FIG. 10A, one or more magnetic field directing materials 909*a*, 909*b*, 910*a*, and 910*b* or shields may be positioned between the inductive receive coil 907 and the housing 903 and/or the inductive transmit coil 908 and the housing 904. These magnetic field directing materials may block or direct the magnetic flux 1001*b* from portions of the respective housings.

As illustrated, the magnetic field directing materials 909*a*, 909*b*, 910*a*, and 910*b* may shape the magnetic flux 1001*b* to block the magnetic flux from the sides of the respective housings 903 and 904. This may reduce interaction between the magnetic flux and the side portions of the housing, thereby reducing or preventing the formation of eddy currents in the side portions, efficiency losses in the inductive power transmission, and/or increases in temperature at the side portions.

In various implementations, the magnetic field directing materials 909*a*, 909*b*, 910*a*, and 910*b* may be formed of a diamagnetic material. A diamagnetic material is a material that creates a magnetic field in opposition to an externally applied magnetic field, thus causing a repulsive effect. Such diamagnetic materials may include graphite, bismuth, graphene, pyrolytic carbon, and so on.

In some implementations, the magnetic field directing materials 909*a*, 909*b*, 910*a*, and 910*b* may be formed of a superconductive material. A superconductive material is a material that exhibits zero electrical resistance and expels magnetic fields when cooled below a characteristic critical temperature. Such superconductive materials may include a lanthanum-based cuprate perovskite material, yttrium barium copper oxide, lanthanum oxygen fluorine iron arsenide, and so on.

In various implementations, such as implementations where the magnetic field directing materials 909*a*, 909*b*, 910*a*, and 910*b* are formed of a relatively highly thermally conductive material such as graphite, the magnetic field directing materials may operate as a heat spreader. In such implementations, the magnetic field directing materials may dissipate heat generated by the inductive power transmission and/or from other heat generation sources (such as heat generated by power dissipating components, solar loading, and so on).

Further, in implementations where the magnetic field directing materials 909*a*, 909*b*, 910*a*, and 910*b* operate as a heat spreader, the magnetic field directing materials may be configured to optimize their heat dissipation properties. In general, the amount of heat that the magnetic field directing materials are able to dissipate in a particular period of time may be related to the surface area of the magnetic field directing materials, the thickness of the magnetic field directing materials, and/or other such factors.

For instance, in some examples the magnetic field directing materials 909*a*, 909*b*, 910*a*, and 910*b* may be configured to increase length (shown vertically in FIG. 10B) and/or width (not shown in FIG. 10B as FIG. 10B is a cross sectional view) with respect to thickness (shown horizontally in FIG. 10B) such that the magnetic field directing materials have a large surface area in relation to the amount of material, in order to increase heat dissipation and reduce the time required to dissipate heat while still blocking the magnetic flux 1001*b* from as much of the housings 903 and/or 904 as possible.

By way of another example, the magnetic field directing materials 909*a*, 909*b*, 910*a*, and 910*b* may form one or more projections, such as fins or extensions, in order to increase the surface area of the magnetic field directing materials beyond that occupied by the length and width of the materials. Such projections may enable the magnetic field directing materials to dissipate more heat in a shorter amount of time than embodiments without such structures, and without altering the housings 903 and/or 904 shielded from the magnetic flux 1001*b*.

As illustrated, the magnetic field directing materials 909*a*, 909*b* may be positioned between one or more surfaces of the inductive receive coil 907 and one or more internal portions of the housing 903. As similarly illustrated, the magnetic field directing materials 910*a* and 910*b* may be positioned between one or more surfaces of the inductive transmit coil 908 and one or more internal portions of the housing 904. However, it is understood that this is an example. In various implementations, magnetic field directing material may be positioned between inductive coils and internal housing portions, located within housings, and/or located on one or more external housing surfaces.

In some implementations, the housings 903 and/or 904 themselves may be formed of magnetic field directing materials (such as diamagnetic materials and/or superconductive materials). Alternatively, in various implementations the housings may be formed of paramagnetic materials, combinations of magnetic field directing materials and paramagnetic materials (materials are attracted by an externally applied magnetic field), conductive materials, and/or any other materials.

As illustrated, the magnetic field directing materials 909*a*, 909*b*, 910*a*, and 910*b* are positioned on both internal sides of both housings 903 and 904. However, it is understood that this is an example. In various implementations, any number, or amount, of magnetic field directing materials may be variously positioned without departing from the scope of the present disclosure.

For example, in some implementations the first electronic device 901 may include the magnetic field directing materials 909*a* and 909*b* whereas the magnetic field directing materials 910*a* and 910*b* may be omitted from the second electronic device 902. By way of another example, in various implementations the first electronic device may include the magnetic field directing materials 909*b* but omit the magnetic field directing material 909*a* and the second electronic device may include the magnetic field directing material 910*b* but omit the magnetic field directing material 910*a*. By way of another example, magnetic field directing material may be included on just one side/region of the first and/or second electronic device 901 and 902, on a top internal surface of the housing 903 and/04 904, and so on. Various configurations are possible and contemplated.

By way of yet another example, in some implementations the first electronic device 901 and/or the second electronic device 902 may include magnetic field directing material in addition to the magnetic field directing materials 909*a*, 909*b*, 910*a*, and 910*b*. In some instances of this example the additional magnetic field directing material may be positioned within and/or on one or more external surfaces of the housings 903 and/or 904.

In still another example, in various implementations magnetic field directing material may be positioned to surround all surfaces of the inductive receive coil 907 and/or the inductive transmit coil 908 without departing from the scope of the present disclosure. For example, FIG. 10C is a cross-sectional side view of a third implementation of the inductive power transmission system 900 of FIG. 9, taken along the section C-C of FIG. 9.

In this implementation, the magnetic field directing material 909*c* may surround all surfaces of the inductive receive coil 907 other than the surface facing the magnetic path toward the inductive transmit coil 908. Similarly, the magnetic field directing material 910*c* may surround all surfaces of the inductive transmit coil other than the surface facing the magnetic path toward the inductive receive coil. As such, the magnetic field directing materials 909*c* and 910*c* may shape the magnetic flux 1001*c* to block the magnetic flux 1001*c* from all surfaces of the housings 903 and 904 that are not in the magnetic path of the inductive power transmission.

Figure 10C:
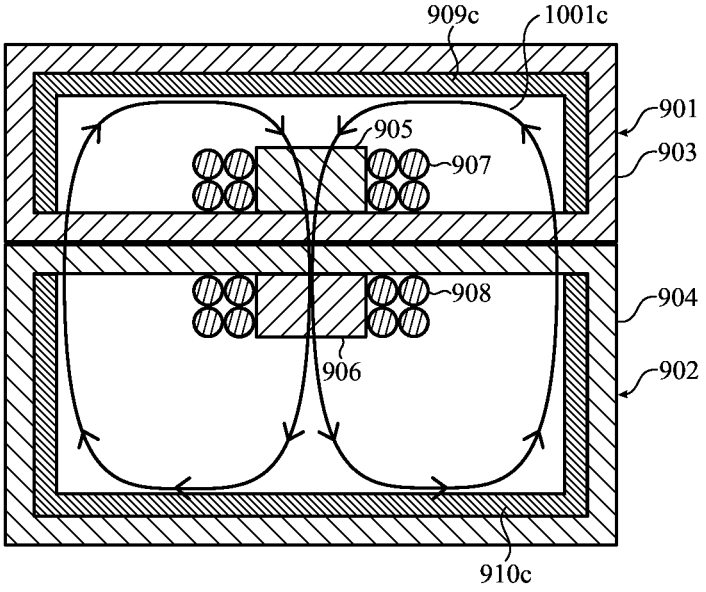
FIG. 10C is a cross-sectional side view of a third implementation of the inductive power transmission system of FIG.

Although FIGS. 10A-10C illustrate the magnetic fields 100*a*-1000*c* as circulating in one sample direction, it is understood that this is an example. In other embodiments, one or more of the magnetic fields 100*a*-1000*c* may be reversed without departing from the scope of the present disclosure.

Figure 11:
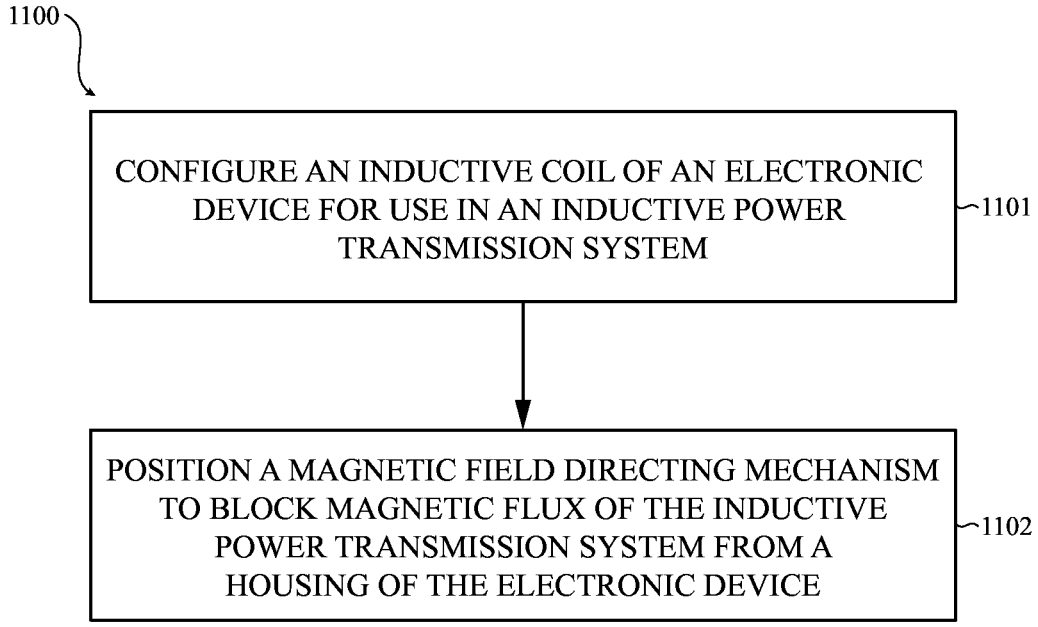
FIG. 11 is a method diagram illustrating an example method for manufacturing an inductive power transmission system. This example method may be performed by the systems of FIGS. 9, 10B, and/or 10C.

FIG. 11 is a method diagram illustrating an example method 1100 for manufacturing an inductive power transmission system. This example method may be performed by the systems of FIGS. 9, 10B, and/or 10C.

The flow may begin at block 1101 where an inductive coil of an electronic device may be configured for use in an inductive power transmission system. The inductive coil may be a transmit coil and/or a receive coil. In some implementations, configuring the inductive coil for use in an inductive power transmission system may include configuring the inductive coil to inductively transmit and/or receive power. In other implementations, configuring the inductive coil for use in an inductive power transmission system may include configuring the inductive coil to inductively transmit and/or receive power from another inductive coil.

The flow may then proceed to block 1102 where a magnetic field directing mechanism is positioned to block magnetic flux of the inductive power transmission system from a housing of the electronic device. Such a magnetic field directing mechanism may include materials such as diamagnetic materials, superconductive materials, and so on that are operable block the magnetic flux.

Although the method 1100 is illustrated and described above as including particular operations performed in a particular order, it is understood that this is an example. In various implementations, various orders of the same, similar, and/or different operations may be performed without departing from the scope of the present disclosure.

For example, block 1102 is illustrated and described as positioning a magnetic field directing mechanism to block magnetic flux of the inductive power transmission system from a housing of the electronic device. However, in some implementations the interaction between the magnetic flux and the housing portion may be reduced as opposed to entirely blocked without departing from the scope of the present disclosure. Such reducing of the interaction between the magnetic flux and the housing portion may be performed utilizing materials such as diamagnetic materials, superconductive materials, and so on.

By way of another example, in various implementations an additional operation of configuring the magnetic field directing mechanism to dissipate heat as a heat spreader may be performed without departing from the scope of the present disclosure. Such heat may be generated by the inductive power transmission and/or by other factors such as heat generated by power dissipating components, solar loading, and so on.

Although FIGS. 1-11 are discussed in the context of various embodiments, it is understood that these are examples. In various implementations, various features of various different discussed embodiments may be utilized together without departing from the scope of the present disclosure.

Figure 12:
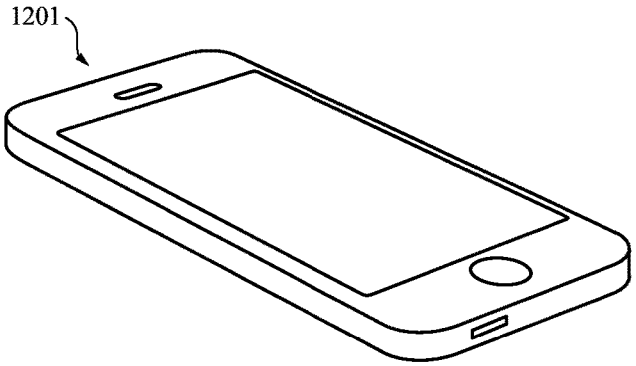
FIGS. 12-14 illustrate isometric views of sample electronic devices in which various embodiments of the magnetic shielding techniques disclosed herein may be utilized.
Figure 13:
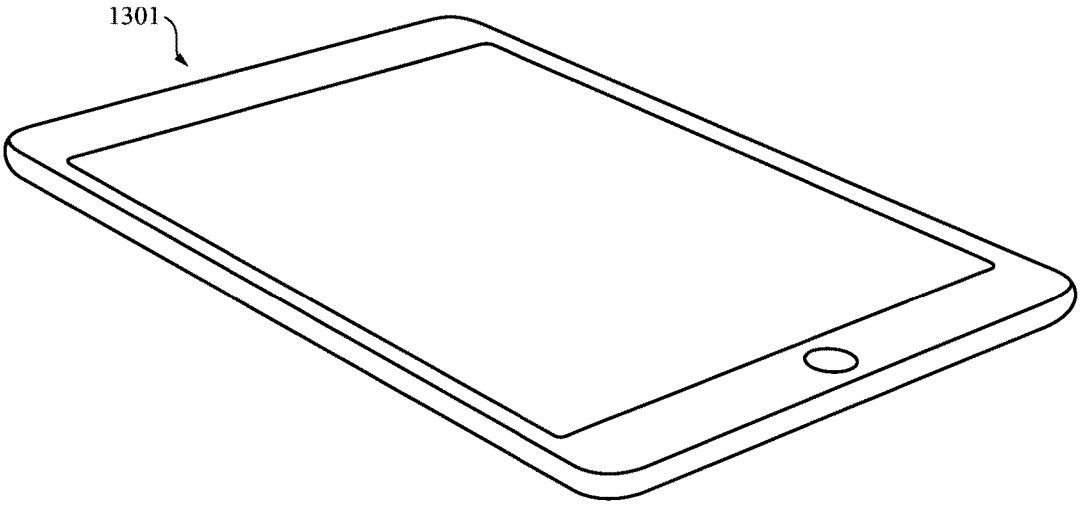
Figure 14:
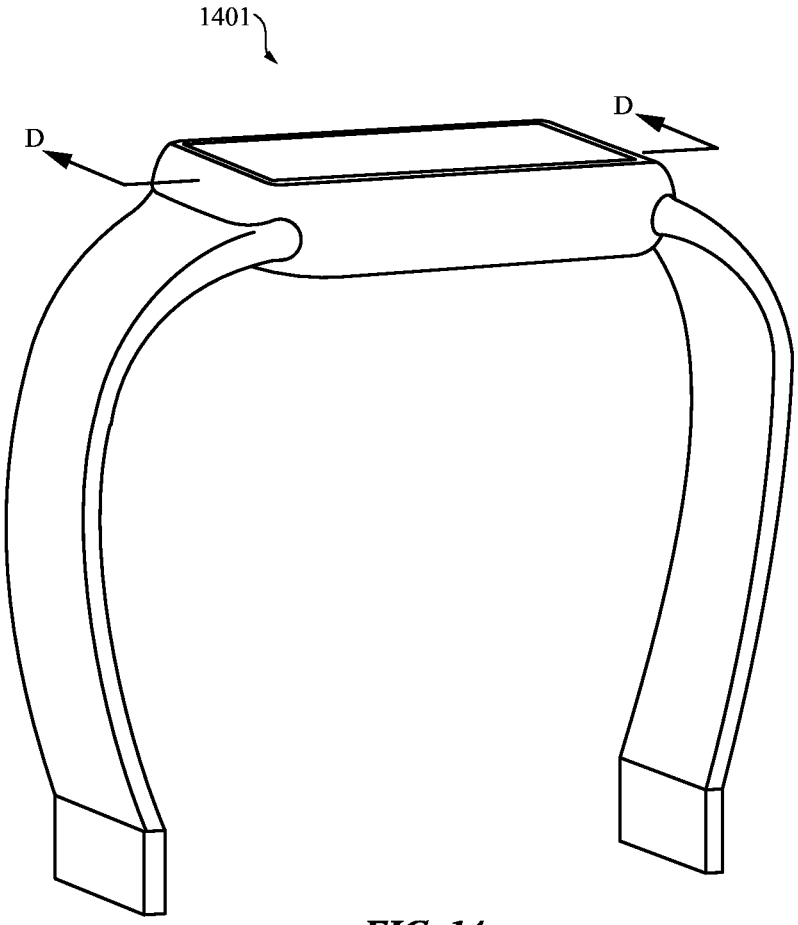

FIGS. 12-14 illustrate isometric views of sample electronic devices 1201-1401 in which various embodiments of the magnetic connection and alignment techniques disclosed herein may be utilized. As illustrated, FIG. 12 illustrates a smart phone 1201, FIG. 13 illustrates a tablet computer 1301, and FIG. 14 illustrates a wearable device 1401. However, it is understood that these are examples and that embodiments of the magnetic connection and alignment techniques disclosed herein may be utilized in a wide variety of different electronic devices without departing from the scope of the present disclosure.

Although FIGS. 1-11 illustrate various configurations of components (such as inductive power receiving coil 107*a* and 107*b*, inductive power transmitting coil 113*a* and 113*b*, and magnetic elements 105 and 111), it is understood that these are examples. Various other configurations are possible in various implementations without departing from the scope of the present disclosure.

Figure 15:
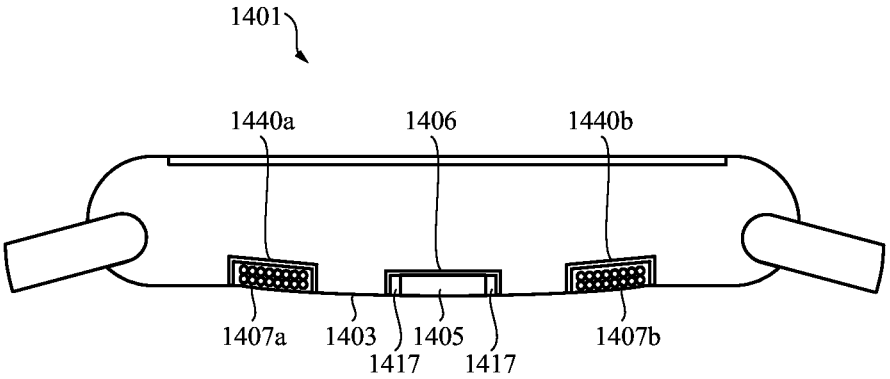
FIG. 15 is a schematic cross sectional side view of the wearable device of FIG. 14, taken along section D-D of FIG. 14.

For example, FIG. 15 is a schematic cross sectional side view of the wearable device 1401 of FIG. 14, taken along section D-D of FIG. 14, illustrating another sample configuration of inductive power receiving coil 1407*a* and 1407*b*, first magnetic element 1405, first connection surface 1403, shield elements 1440*a* and 1440*b*, and shield element 1406. However, it is understood that this configuration is also an example and that still other configurations are possible without departing from the scope of the present disclosure.

For example, in various implementations one or more magnetic field directing materials such as the magnetic field directing materials 909*a*, 909*b*, and/or 909*c* of FIGS. 10A-10C may be positioned on various portions of and/or inside the housing of the wearable device 1401 without departing from the scope of the present disclosure.

As described above and illustrated in the accompanying figures, the present disclosure discloses systems and methods for magnetic shielding in inductive power transfer. A first electronic device with a first connection surface and an inductive power transfer receiving coil and first magnetic element positioned adjacent to the first connection surface connects in an aligned position with a second electronic device with a second connection surface and an inductive power transfer transmitting coil and second magnetic element positioned adjacent to the second connection surface. In the aligned position, the relative position of first and second electronic devices may be maintained by magnetic coupling between the first and second magnetic elements. In the aligned position the inductive power transfer transmitting coil may be configured to transmit power to the inductive power transfer receiving coil. The first and/or second magnetic elements and/or the inductive power transfer receiving and/or transmitting coils may be configured to minimize or reduce eddy currents caused in the first and/or second magnetic elements by the inductive power transfer receiving and/or transmitting coils. In this way, magnetic connection mechanisms may be utilized without impairing the inductive power transfer and/or causing excessive heat.

In the present disclosure, the methods disclosed may be implemented utilizing sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may utilize a computer program product, or software, that may include a non-transitory machine-readable medium having stored thereon instructions, which may be used to program a computer system (such as a computer controlled manufacturing system and/or other electronic devices) to perform a process utilizing techniques of the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A first electronic device, comprising:

a first connection surface;

an inductive power transfer receiving coil positioned adjacent to the first connection surface;

a first magnetic element positioned adjacent to the first connection surface; and a shield at least partially positioned between the inductive power transfer receiving coil and the first magnetic element; wherein:

a portion of the shield positioned between the first magnetic element and the inductive power transfer receiving coil defines a gap between the shield and the first magnetic element;

the shield is configured to reduce an eddy current caused in the first magnetic element by the inductive power transfer receiving coil;

the first magnetic element couples to a second magnetic element of a second electronic device to maintain an aligned position between the first and second electronic devices; and the inductive power transfer receiving coil is configured to inductively receive power from an inductive power transfer transmitting coil of the second electronic device when the first electronic device and the second electronic device are in the aligned position.

2. The first electronic device of claim 1, further comprising a nonconductive and magnetically permeable coating on the first magnetic element.

3. The first electronic device of claim 2, wherein the nonconductive and magnetically permeable coating is formed of at least one of polymer, a combination of the polymer and conductive fibers, or a combination of the polymer and conductive particles.

4. The first electronic device of claim 1, wherein the shield is coupled to the first magnetic element.

5. The first electronic device of claim 4, wherein the shield is formed of at least one of an electrically nonconductive material, a soft magnetic material, a ferromagnetic material, a ceramic material, a crystalline material, or iron cobalt.

6. The first electronic device of claim 4, wherein the shield directs a magnetic field of the first magnetic element toward the first connection surface.

7. The first electronic device of claim 4, wherein at least a portion of the shield is coated with a nonconductive coating.

8. The first electronic device of claim 1, wherein a spacing between the first magnetic element and the inductive power transfer receiving coil is configured to reduce the eddy current.

9. A system for magnetic shielding for an inductive power transfer, the system comprising:

a first electronic device, comprising:

a first connection surface;

an inductive power transfer receiving coil positioned adjacent to the first connection surface; and a first magnetic element positioned adjacent to the first connection surface; and a second electronic device, comprising:

a second connection surface;

an inductive power transfer transmitting coil positioned adjacent to the second connection surface; and a second magnetic element positioned adjacent to the second connection surface; wherein:

the inductive power transmitting coil inductively transmits power to the inductive power transfer receiving coil; and at least one of first magnetic element or the inductive power transfer receiving coil includes a shield that is configured to reduce an eddy current caused in the first magnetic element as a result of inductively transmitting power to the inductive power receiving coil, wherein the shield is at least partially positioned between the inductive power transfer receiving coil and the first magnetic element, and wherein a portion of the shield defines a gap between the shield and the first magnetic element.

10. The system of claim 9, wherein the shield is coupled to the inductive power transfer receiving coil and is configured to reduce the eddy current.

11. The system of claim 10, wherein the shield is a Faraday cage.

12. The system of claim 10, wherein the shield is formed of at least one of a crystalline material, a ceramic material, a soft magnetic material, a ferromagnetic material, or an iron silicon.

13. The system of claim 9, wherein the first connection surface is formed of a nonconductive material.

14. The system of claim 9, wherein at least one of:

at least one of the second magnetic element or the inductive power transfer receiving coil is configured to reduce eddy currents caused in the second magnetic element by the inductive power transfer receiving coil; or at least one of the first magnetic element or the inductive power transfer transmitting coil is configured to reduce eddy currents caused in the first magnetic element by the inductive power transfer transmitting coil.

15. An electronic device, comprising:

a housing;

an inductive coil located within the housing and operable to transmit or receive power in an inductive power transmission system;

a magnetic field directing material positioned either within or on the housing, wherein the magnetic field directing material blocks magnetic flux of the inductive power transmission system from the housing; and a magnetic element disposed in the housing, wherein the magnetic field directing material is at least partially positioned between the inductive coil and the magnetic element, and wherein a portion of the magnetic field directing material defines a gap between the magnetic field directing material and the magnetic element.

16. The electronic device of claim 15, wherein the magnetic field directing material comprises at least one of a diamagnetic material or a superconductive material.

17. The electronic device of claim 16, wherein the diamagnetic material comprises at least one of graphite, bismuth, graphene, or pyrolytic carbon.

18. The electronic device of claim 15, wherein the magnetic field directing material is positioned between the inductive coil and the housing.

19. The electronic device of claim 15, wherein the magnetic field directing material is positioned on an interior surface of the housing.

20. The electronic device of claim 15, the housing including the magnetic field directing material.

21. The electronic device of claim 15, further comprising an additional magnetic field directing material positioned outside the housing.

22. The electronic device of claim 21, wherein the magnetic field directing material comprises a thermally conductive material.

23. The electronic device of claim 22, wherein the thermally conductive material is configured to operate as a heat spreader.

24. The electronic device of claim 15, wherein the housing comprises at least one of a paramagnetic material or a diamagnetic material.

25. The electronic device of claim 15, wherein the magnetic field directing material is positioned between multiple surfaces of the inductive coil and the housing.

26. The electronic device of claim 15, wherein the magnetic field directing material surrounds all surfaces of the inductive coil other than a surface of the inductive coil facing a magnetic path of the inductive power transmission system.

27. The electronic device of claim 15, wherein the magnetic field directing material is configured to shape a flow of the magnetic flux.

28. The electronic device of claim 15, wherein the magnetic field directing material is configured to prevent formation of eddy currents in the housing.

29. The electronic device of claim 15, wherein the magnetic field directing material is configured to reduce efficiency losses of the inductive power transmission system.

* * * * *